United States Patent [19]

Walters

[11] Patent Number: 4,457,574

[45] Date of Patent: Jul. 3, 1984

[54] ELECTROMAGNETICALLY SHIELDED CONNECTOR

[75] Inventor: Gerald E. Walters, Granada Hills, Calif.

[73] Assignee: Automation Industries, Inc., Greenwich, Conn.

[21] Appl. No.: 346,281

[22] Filed: Feb. 5, 1982

[51] Int. Cl.[3] ..... H01R 13/648

[52] U.S. Cl. ..... 339/143 R

[58] Field of Search ..... 339/14 R, 143 R; 333/260

[56] References Cited

U.S. PATENT DOCUMENTS 3,743,979 7/1973 Schor ..... 339/143 R X 3,825,874 7/1974 Peverill ..... 339/14 R

*Primary Examiner*—Eugene F. Desmond

*Attorney, Agent, or Firm*—Francis N. Carten

[57] ABSTRACT

The present invention is directed to a shielded plug and socket in which the socket is provided with a fixed and a movable shield to protect the socket against magnetic electromagnetic interference when the socket is disconnected from the plug.

13 Claims, 4 Drawing Figures

ELECTROMAGNETICALLY SHIELDED CONNECTOR

The present invention relates generally to an electrical connector and, more particularly, to an electrical connector of the pin and socket variety with plug and receptacle parts releasably mated, one of which parts being shielded against electromagnetic energy environments.

BACKGROUND OF THE INVENTION

An especially well-received releasable electrical connector includes plug and receptacle parts which can be mated together to effect connection between pins and sockets carried by the respective parts. By virtue of the heavy metal shells, when the two connector halves are mated, there is a relatively good protection against external electromagnetic fields inducing undesirable voltages in the wires and thus via the shielded cables into electrical equipment to which the cables are connected. However, when the plug and receptacle are separated, the exposed interconnection electrodes are readily influenced by environmental electromagnetic fields.

In U.S. Pat. No. 3,550,065 there is described the use of a metal plate for being received onto the open end of a connector half in which the socket electrodes are mounted, which plate has openings via which pins from the other connector half can pass for mating interconnection with the sockets. This grid plate or shield is electrically connected with the connector metal casing or shell and serves to act as a shield for reflection and absorption of external electromagnetic energy thereby preventing or substantially reducing the induction of electric currents in the connector sockets and thus into the cable wires and equipment interconnected therewith.

Although the technique and structure of the shield described in the referenced United States patent is generally effective, the electromagnetic environments being encountered today are becoming increasingly severe in terms of both intensity and frequency, and this is especially true in connection with military components necessitating the adoption of even better shielding means. For example, in the event of a nuclear explosion an electromagnetic pulse (EMP) is produced which can literally by itself damage or destroy electrical and electronic equipment at distances from the blast sufficient for safety from the actual blast effects.

SUMMARY OF THE INVENTION

In accordance with the practice of this invention, there is provided over the open end of an electrical connector part including a set of socket electrodes, a first metal grid or shield consisting of a plate with a plurality of openings aligned with the respective sockets. This first metal grid is spaced from the outer end of the sockets and continuously interconnected at its edges with the shell that typically encloses the connector parts.

A second metal grid or shield having a set of openings aligned with those of the first grid is removably located between the first described grid and the outer end of the sockets at a spacing from the first grid depending upon the frequency associated with the guide wavelength. Accordingly, the first metal grid effects substantial reduction of magnetic electromagnetic interference as a result of waveguide cutoff, and the second metal grid reduces the remaining unwanted magnetic field even further by cavity resonance.

In an alternate version, the removable grid or shield is located outwardly of the fixed grid or shield and spaced therefrom. A still further embodiment contemplates spring-loading the removable outer shield to hold it at the required spacing from the fixed grid when the connector is released, and which permits the outer shield to be moved toward the fixed grid when the connector parts are intermated.

DESCRIPTION OF PREFERRED EMBODIMENTS

Figure 1:
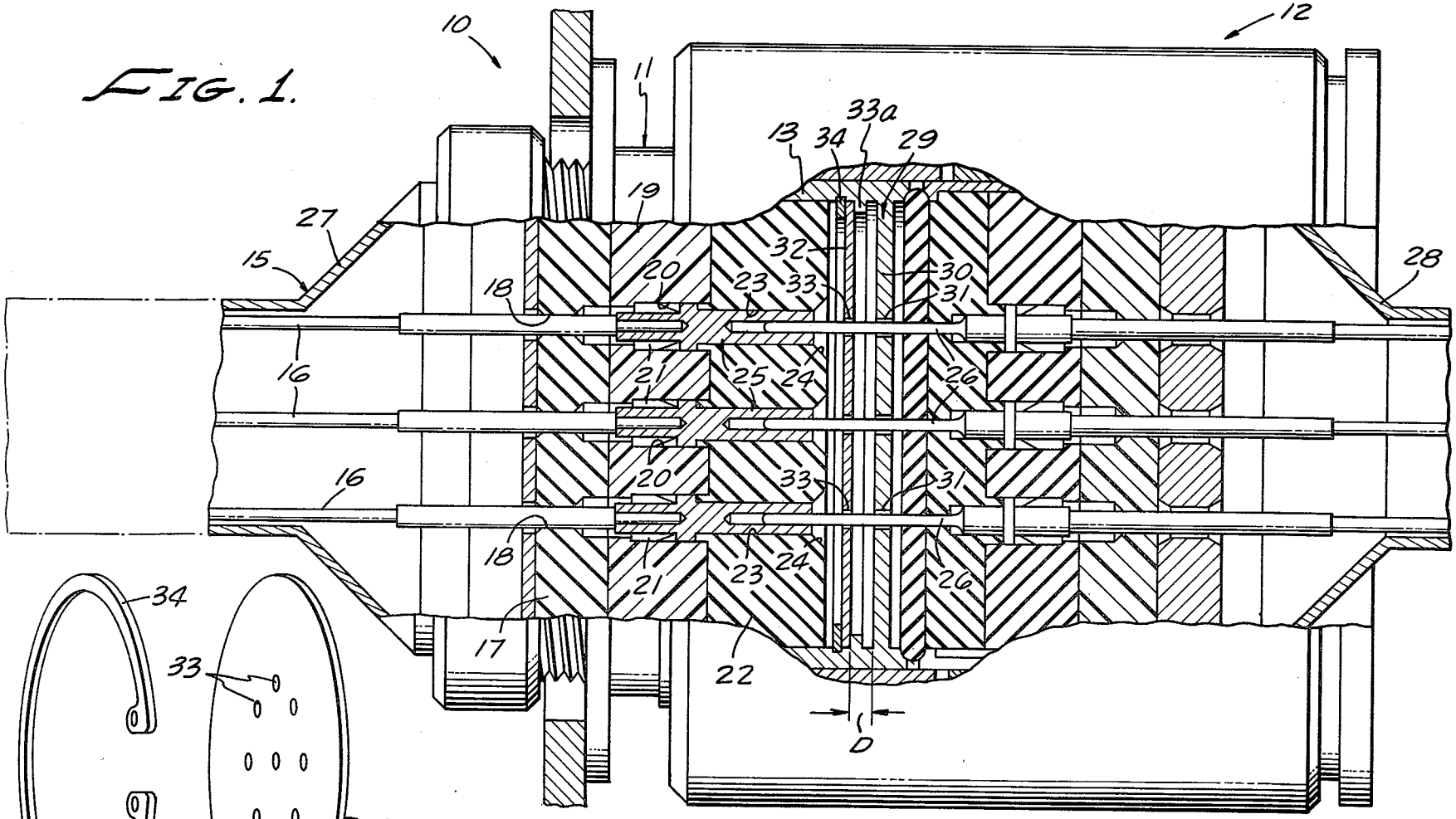
FIG. 1 is a side elevational, sectional, partially fragmentary view of a pin and socket connector incorporating the present invention.

Turning now to the drawings, and particularly FIG. 1 thereof, the electrical cable connector 10 with which the present invention is most advantageously employed, is seen to include a receptacle 11 and plug 12 which are releasably mated to interconnect two wire cables, the ends of which are secured within the receptacle and plug in conventional manner.

The receptacle 11 includes a hollow, generally cylindrical metal housing 13 having a first end 14 for mating receipt within similarly dimensioned parts of the plug 12 and an opposite end 15 for receiving a plurality of cable wires 16 to be interconnected by the connector.

A generally cylindrical wire sealing grommet 17 constructed of a relatively soft, pliable elastomer has peripheral dimensions and geometry enabling fitting receipt within the housing bore. A plurality of spaced parallel openings 18 extend completely through the body of insert 17 for accommodating an equal plurality of cable wires 16 and sealing against access to the connector interior by moisture, dirt, dust or other foreign matter.

A rear insert half insert 19 located immediately adjacent to grommet 17 is constructed of a suitable insulative material and has peripheral geometry and dimensions similar to the grommet such that it will tightly conform to the internal housing wall. Aligned with each of the openings 18 in the grommet 17 are guide insert openings 20. The openings 20 have a portion that is slightly larger than the openings 18 within which are forwardly directed spring clips 21 for a purpose to be described.

A front insert half insert 22 has peripheral dimensions and geometry such as to fit snugly within the housing and includes openings 23 aligned with the openings 18 of the insert 17 and, similarly, with the openings 20 in rear insert half insert 19. More particularly, the openings 23 have a relatively large cross-section from the insert face which abuts against 19 and reduces to a smaller diameter opening 24 that faces outwardly of the connector or to the right as shown in FIG. 1. The opening 24 is tapered so as to promote ease of pin acceptance in case of misalignment. Socket electrodes 25 when assembled have their leading ends received within the openings 23 of insert 22, their trailing parts extending backwardly through openings 20 of rear insert half insert 19 and further include enlarged flanges which when passed over the spring clips 21 serve to retain the sockets firmly in place.

In a conventional manner, the cable wires 16 are received within openings formed in the back or trailing ends of the sockets 25 and secured therein by crimping, for example. The forward ends of the sockets 25 are adapted to receive the elongated shafts of pin electrodes 26 and in that manner effect the electrical connection desired. The pins are mounted in the other connector part or plug in a somewhat similar manner to that just described for the sockets.

The plug and receptacle connector described to this point is of conventional construction. The cable wires leading into each connector part are enclosed within a grounding sheath 27 and 28, respectively, which, in turn, are connected to the connector part shells or housing. Accordingly, when the connector parts are mated the cable wires, pins and sockets are all enclosed within a grounded conductive member which protects them from external electromagnetic interference by reflecting some and absorbing the remainder.

Figure 2:
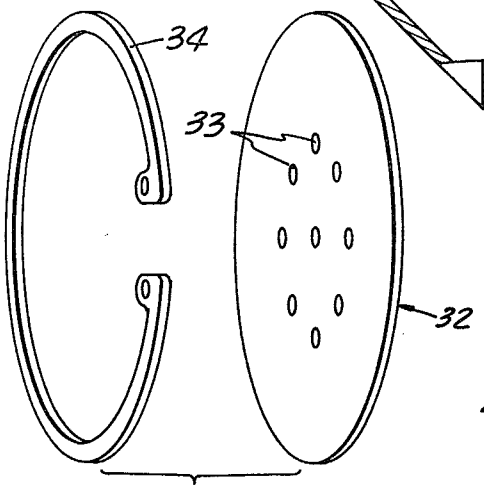
FIG. 2 is an enlarged perspective view of a metal grid or shield and securing means for use in the present invention.

For the ensuing description of a first embodiment of this invention for shielding the open end of the receptacle, reference is now made simultaneously to FIGS. 1 and 2. A first or fixed electromagnetic shield 29 includes a plate 30 spaced from the outer end of the sockets and which extends completely across and encloses the open end of the receptacle. A plurality of openings 31 are formed in the plate in alignment with the sockets in the receptacle, but with diameters that clear pins including dimensional allowance to prevent electrical shorting of pin current to metal plate. More particularly, the plate 30 is a machined part and fully unitary with the receptacle shell 11 forming a consistent uniform metallic enclosure for the open end of the socket containing the receptacle except for the openings therein.

As set forth in the referenced U.S. patent, the plate openings 31 form waveguides having a high frequency cut-off so that they act as wave traps to electromagnetic energy impinging on the plate outer surface preventing passage of the energy to the sockets. That is, not only does the solid part of plate 30 reflect and absorb incident electromagnetic energy, but also the openings serve as wave traps to still further reduce that amount of such energy which reaches the sockets. Therefore, the total reduction of electromagnetic energy that reaches the sockets is a function of the metal plate thickness, and the diameter and number of openings in the plate.

A second metal grid or shield 32 consists essentially of a metal disc as shown in FIG. 2, having openings 33 which can be aligned with those in the first metal grid 30, and thus, of course, with the openings in the sockets. The disc has its outer edge portions abutting against a shoulder 33 formed in the wall of the receptacle housing and is secured in place by a C-clip 34 fittingly received in a suitable groove in the housing wall.

The spacing D between the first and second metal shields is selected in order to set up cavity resonance. That is, it is an important feature of the described invention to be able to reduce the wall thickness of the first metal shield 28 and to compensate for this corresponding reduction in shielding by resonating the leakage of energy that gets past the first shield between the first and second shields. Tests have shown that two relatively thin shields perform better than one shield of the same accumulated metal thicknesses and an improvement of the order of 10 to 20 decibels has been measured in a practical construction.

More particularly, it can be shown that the space between the shields 29 and 32 to produce resonance for electromagnetic energy is generally defined by the following mathematical relationship:

$$D = \phi \frac{\lambda}{2}$$

$\phi = 1,2,3, \ldots$
$\lambda =$ guide wavelength

Although the second shield 32 can act as a cut-off shield in much the same manner as the first shield 29, the most important effect that is believed to take place is that resonance occurs in the cavity between the first and second shields. That is, if the frequency of the guide wavelength varies even slightly from the defined relationship to the cavity dimensions set forth in the previous formula, the internal field intensity within the cavity drops substantially to zero everywhere.

Figure 3:
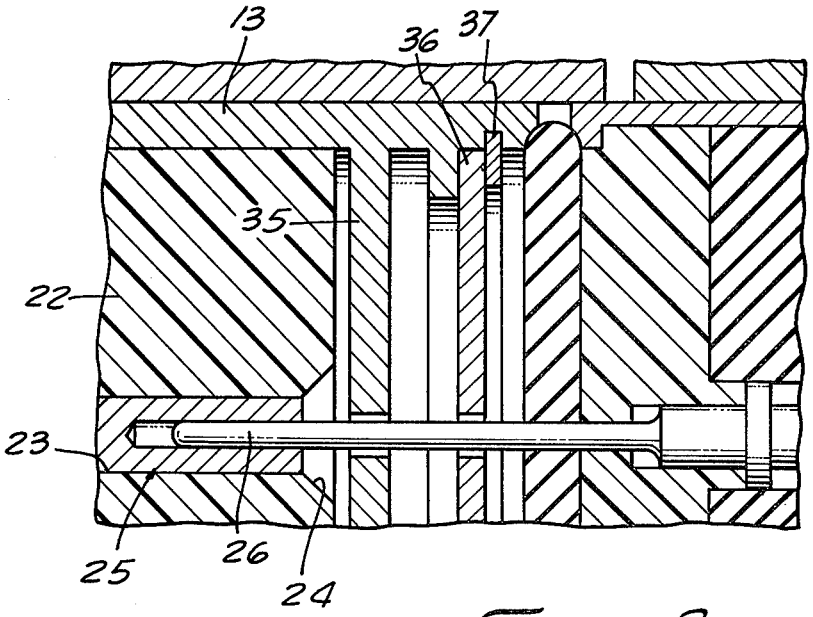
FIG. 3 is an enlarged side elevational view of an alternate embodiment.

With reference now to FIG. 3, an alternate form of the invention is depicted in which the permanent or fixed-position metal shield 35 is located immediately adjacent the insert carrying the sockets. The removable disc or shield 36 is located outwardly of the first shield. Otherwise, the two shields 35 and 36 are constructed identically to the shields 29 and 32, respectively, of the first described embodiment. That is, the inner or fixed metal shield 35 is machined as a part of the connector receptacle shell and is located substantially inwardly of the outer end of the receptacle shell. Similarly, the removable disc shield 36 is held in place by a C-clip 37 as in the first described version.

Figure 4:
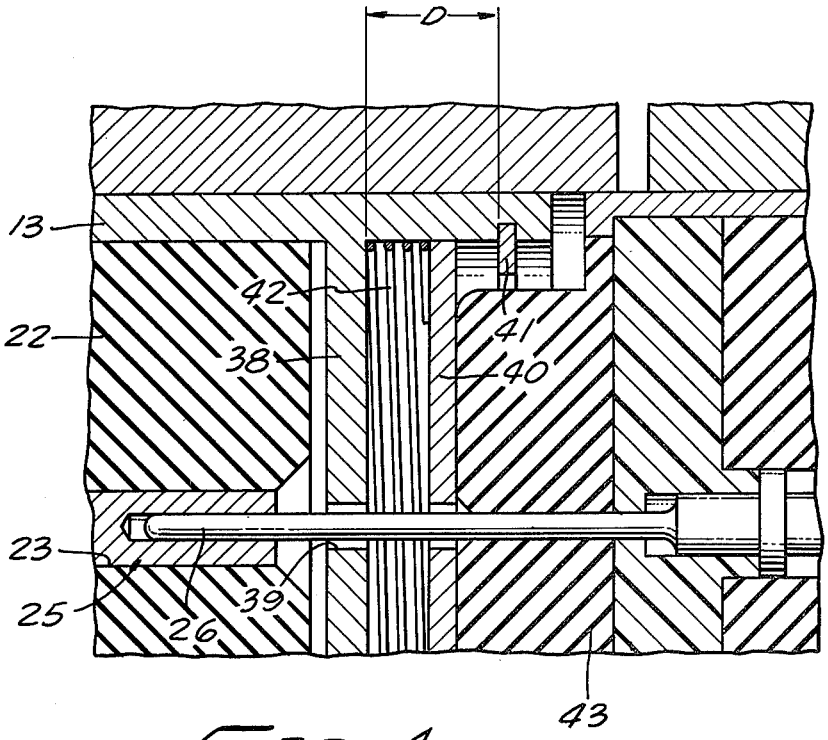
FIG. 4 is a side elevational, sectional view similar to FIG. 3 of a still further form of the invention.

Turning now to FIG. 4, there is shown a still further embodiment of the invention which is especially advantageous where circumstances require that the engaged length of the connector be kept at a minimum while at the same time a relatively larger space D between the two shields is required on disengagement of the connector (e.g., 0.500 in. or 1.27 cm.). The innermost shield 38 is a machined part of the receptacle shell and located immediately adjacent the connector insert 22 with openings 39 aligned with the socket openings for receipt of pins therethrough when the connector is joined. The removable or second shield 40 includes a metal disc with openings for accommodating the pins and is secured on its outside edge margin by a C-clip 41. The disclike shield conforms to the internal circular dimensions of the receptacle shell and is held at its back or inner side by a spring 42 which also resiliently engages the outwardly directed surface of the first shield 38. Although the spring 42 is depicted as a coil spring, it is to be understood that any spring, such as an elastomer, or a leaf spring, for example, is suitable as long as it does not interfere with the pins.

In use, when the connector parts are disconnected from one another, the removable or second shield 40 is held at a fixed space relation to the first shield 38 by the spring 42 which urges the shield 40 into contact with the C-clip 41. However, when the connector parts are engaged, an insulative portion 43 of the plug presses against the second shield forcing it inwardly against the coiled spring 42. In this way, both requirements of a relatively large spacing D when the connector parts are disconnected is obtained, while a closer spacing between the shields is achieved on full engagement of the connector parts.

In each version, the described shields, both removable and fixed, include openings through which the pins must pass. It is important that the shield openings be sufficiently large to prevent electrical breakdown between the current carrying pins and the grounded shield/s. It is believed that an optimum diameter for the shield openings should not be less than twice the diameter of the pin received therein.

In the practice of this invention a technique is utilized for shielding the open end of an electrical connector part including one or more exposed socket electrodes. Two foraminous metal plates are located over the open connector part in a preferred spatial arrangement such that the effect of external electromagnetic fields on the socket electrodes is reduced, or substantially eliminated, by the twin effects of waveguide cutoff and cavity resonance. Although these shields would be effective when made of any metal (i.e., good electrical conductor), it is preferable that they be made of the same metal as the receptacle shell so as to reduce unwanted current flow resulting from differential voltages being induced in the different metal parts.

A still further enhancement of each version of the described connector can be obtained by forming a coating on the surfaces between the shields of an electromagnetically absorbent material. Such a material can include an electrically insulative carrier within which ferromagnetic particles are suspended. For best results, the facing surfaces of the two shields and the plug shell inner wall surface between the shields should include the coating. An excellent material for this purpose is sold under the trade designation Cobaloy P-212 by Graham Magnetics, Inc. of Richland Hills, Texas.

I claim:

1. An electromagnetic shield for an electrical connector within a metal shell and having an open end, comprising:

a first electrically conductive plate having its edges affixed to the metal shell and including at least one opening passing therethrough;

a second electrically conductive plate spaced from said first plate and having edge margins in continuous contact with a generally circular shoulder on the connector shell, said second plate including an opening aligned with the opening in said first plate and being located outwardly of the first plate; and spring means resiliently maintaining the first and second plates at the predetermined spacing.

2. An electromagnetic shield for an electrical connector within a metal shell and having an open end, comprising:

a first electrically conductive plate having its edges affixed to the metal shell and including at least one opening passing therethrough; and a second electrically conductive plate spaced from said first plate at a distance as to set up cavity resonance between the two plates of incident electromagnetic energy and releasably contacting the metal shell, said second plate including an opening aligned with the opening in said first plate.

3. An electromagnetic shield as in claim 2, in which the spacing between the first and second plates is defined by the mathematical equation $D=\phi\lambda/2$, where D is the plate spacing, $\phi$ is any whole number, and $\lambda$ is a specific wavelength of electromagnetic energy it is desired to resonate in the space between said first and second plates.

4. An electromagnetic shield as in claim 2, in which the first and second plates are constructed of the same metal as the connector shell.

5. An electromagnetic shield as in claim 2, in which the second plate has its edge margins in continuous contact with a generally circular shoulder on the connector shell.

6. An electromagnetic shield as in claim 5, in which the second plate is spaced inwardly from the first plate.

7. An electromagnetic shield as in claim 5, in which the second plate is spaced outwardly from the first plate.

8. An electromagnetic shield for an electrical connector within a metal shell and having an open end, comprising:

a first electrically conductive plate having its edges affixed to the metal shell and including at least one opening passing therethrough;

a second electrically conductive plate spaced from said first plate and releasably contacting the metal shell, said second plate including an opening aligned with the opening in said first plate; and a coating on each of the facing surfaces of the first and second plates and on the inwardly directed shell surface between the plates, said coating including an insulative carrier within which ferromagnetic particles are suspended.

9. An electrical connector part having an outer metal shell within which is located at least one socket contact facing an open end via which a pin contact from a further connector part is received for mating the socket contact, comprising:

a first metal plate integrally formed with the connector part shell and covering the open end, said plate having an opening aligned with said socket; and a second metal plate located at a predetermined spacing from the first plate, the edge margins of said second plate releasably held in abutting contact with a shoulder formed in the inner wall of the connector shell;

said second plate including an opening aligned with the opening in the first plate, the width of said plate openings being at least twice the cross-sectional dimension of the pin contact.

10. An electrical connector as in claim 9, in which facing surfaces of the first and second metal plates and the shell inner wall surface between said metal plates is covered by a coating of a material including suspended ferromagnetic particles.

11. An electrical connector part as in claim 9, in which the second plate is located inwardly of the first plate.

12. An electrical connector part as in claim 9, in which the second plate is located outwardly of the first plate.

13. An electrical connector part as in claim 12, in which a coil spring resiliently holds the second plate against the shoulder, said plate being free to move away from said shoulder and toward the first plate on force being applied against said second plate.

* * * * *